United States Patent [19]

Fujimoto et al.

[11] Patent Number: 5,000,134

[45] Date of Patent: Mar. 19, 1991

[54] FUEL SUPPLYING SYSTEM FOR INTERNAL COMBUSTION ENGINE

[75] Inventors: Hiroaki Fujimoto; Seiji Inoue, both of Hamamatsu, Japan

[73] Assignee: Sanshin Kogyo Kabushiki Kaisha, Shizuoka, Japan

[21] Appl. No.: 421,229

[22] Filed: Oct. 13, 1989

[30] Foreign Application Priority Data

Oct. 14, 1988 [JP] Japan ..... 63-259022

[51] Int. Cl.[5] ..... F02M 43/00

[52] U.S. Cl. ..... 123/73 A; 123/531; 123/576

[58] Field of Search ..... 123/299, 300, 179 L, 123/179 SE, 26, 531, 497, 575, 576, 577, 578, 73 A, 73 B, 73 C

[56] References Cited

U.S. PATENT DOCUMENTS

| | | | |
|---|---|---|---|
| 2,173,813 | 9/1939 | Bischof | 123/300 |
| 4,273,087 | 6/1981 | Goloff | 123/575 |
| 4,509,472 | 4/1985 | Slattery | 123/179 G |
| 4,530,324 | 7/1985 | Tanaka et al. | 123/300 |
| 4,693,227 | 9/1987 | Satou | 123/300 |

FOREIGN PATENT DOCUMENTS

| | | | |
|---|---|---|---|
| 1191631 | 4/1965 | Fed. Rep. of Germany | 123/300 |
| 0106163 | 6/1983 | Japan | 123/300 |
| 0116061 | 6/1986 | Japan | 123/575 |

*Primary Examiner*—David A. Okonsky
*Attorney, Agent, or Firm*—Ernest A. Beutler

[57] ABSTRACT

Several embodiments of additional fuel supply systems for internal combustion engines that supply supplemental fuel in addition to the normal charge forming device to satisfy certain specific requirements such as cold starting and cold running. In each embodiment, a separate fuel pump is provided for the supplemental fuel discharge but it is contained within and operated by the same operator of the main fuel pump for supplying fuel to the main fuel discharge. In some embodiments, the fuel pump is downstream of the supplemental fuel control and in other embodiments it is upstream of it. In one embodiment, the fuel pump and the supplemental control are all formed in the same housing.

25 Claims, 5 Drawing Sheets

FUEL SUPPLYING SYSTEM FOR INTERNAL COMBUSTION ENGINE

BACKGROUND OF THE INVENTION

This invention relates to a fuel supplying system for an internal combustion and more particularly to an improved arrangement for providing additional incremental fuel to the engine for certain running conditions.

It is well known that fuel requirements of an engine vary widely with the running and load conditions of the engine. Although the normal charge forming supply for the engine, be it be a carburetor or a fuel injection system, can be tailored to supply the proper amounts of fuel for all such conditions, the tailoring of the charge forming system to supply all of the fuel requirements under all conditions can make it extremely complicated. Therefore, there are certain advantages in providing an additional fuel supply for the engine that supplies incremental amounts of fuel for such particular running conditions as starting, cold warm up and the like. The provision of such an additional fuel supply system can generally simplify the overall charge forming arrangement for the engine. In connection such systems, it is desirable to provide a separate fuel pump for pumping the fuel to the additional fuel supply system. However, the provision of an additional fuel pump for this purpose can complicate the system and give rise to certain other difficulties.

It is, therefore, a principle object of this invention to provide an improved fuel supplying system for an internal combustion engine.

It is a further object of this invention to provide an additional incremental fuel supplying system for an engine in addition to its normal charge forming system which is provided with a separate fuel pump but wherein the fuel pumps for the two systems are integrated into a common housing so as to simplify the overall construction.

It is a further object of this invention to provide a fuel supplying for an engine having a main charge forming system and an incremental fuel delivery system each having its own pump but wherein the pumps are both operated by the safe device.

SUMMARY OF THE INVENTION

This invention is adapted to be embodied in a fuel supply system for an internal combustion engine comprising a main fuel discharge for supplying main running fuel to the engine for normal running conditions. A first fuel pump means supplies fuel to the main fuel discharge. There is also provided an additional fuel supply system for the engine for supplying additional fuel to the engine for specific running conditions and a second fuel pump for supplying fuel to the additional fuel supply.

In accordance with a first feature of the invention, the first and second fuel pumps are formed in the same housing.

In accordance with another feature of the invention, the first and second fuel pumps are operated by the safe operator.

DETAILED DESCRIPTION OF THE PREFERRED EMBODIMENTS OF THE INVENTION

Figure 1:
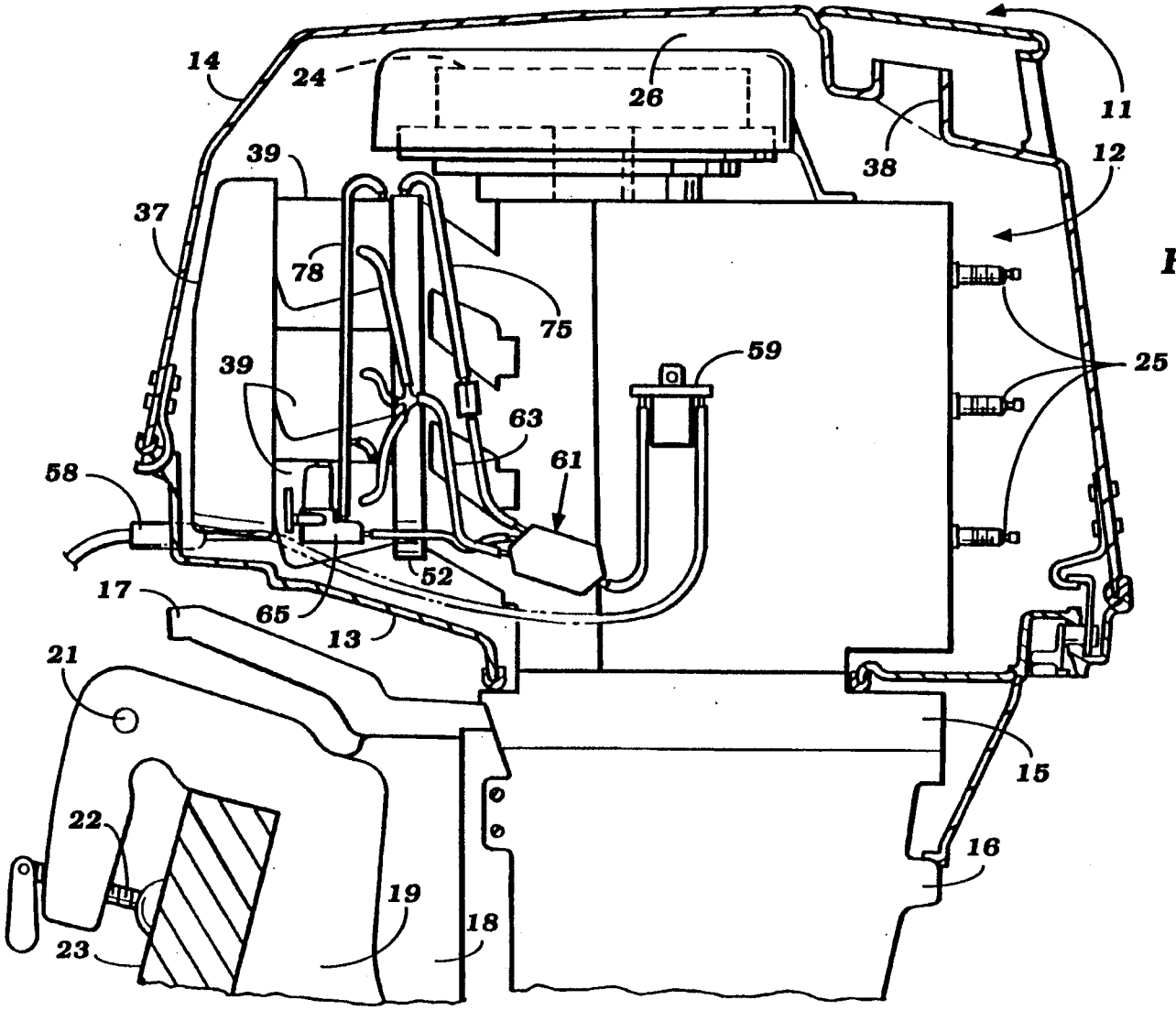
FIG. 1 is a partial side elevational view, with portions broken away and other portions shown in sections of an outboard motor attached to the transom of an associated watercraft and having a fuel supply system constructed in accordance with a first embodiment of the invention.

Referring first to FIG. 1 through 4, an outboard motor constructed in accordance with two slightly different embodiments of the invention is identified generally by the reference numeral 11. The invention is described in conjunction with an outboard motor because the illustrated embodiments all deal with two-cycle crankcase compression engines and such engines are typically employed with outboard motors. It is to be understood, however, that the invention can be utilized in conjunction with engines used for other purposes and also in conjunction with engines other than those operating on the two cycle principle.

The outboard motor 11 includes a power head that is comprised of an internal combustion engine 12 that is surrounded by a protective cowling comprised of a lower tray 13 and a main cover portion 14 that is detachable connected to the tray 13 in a known manner.

As will become apparent in the description of the remaining figures, the engine 12 is supported so that its output shaft rotates about a vertically extending axis and the engine 12 is affixed to the upper side of a spacer place 15. A drive shaft driven by the engine output shaft extends through the spacer plate 15 and into a drive shaft housing 16 that is affixed to the underside of the spacer plate 15. This drive shaft extends to a lower unit (not shown) so as to drive a propeller or other form of propulsion device in a known manner.

The outboard motor 11 further includes a steering shaft (not shown) having a steering tiller 17 affixed to its upper end. This steering shaft is journaled for steering movement within a swivel bracket 18 for steering of the outboard motor 11 in a known manner. The swivel bracket 18 is pivotally connected to a clamping bracket 19 by means of horizontally extending pivot pin 21 for tilt and trim adjustment of the outboard motor. A clamping device 22 is carried by the clamping bracket 19 for attachment of the outboard motor 11 to a transom 23 of an associated watercraft which is only shown partially.

A flywheel magneto 24 is affixed to the upper end of the engine output shaft and fires a series of spark plugs 25, one for each cylinder, by means of a suitable ignition system. The flywheel magneto 24 is covered by a cover plate 26 that is affixed to the cylinder block of the engine.

Figure 2:
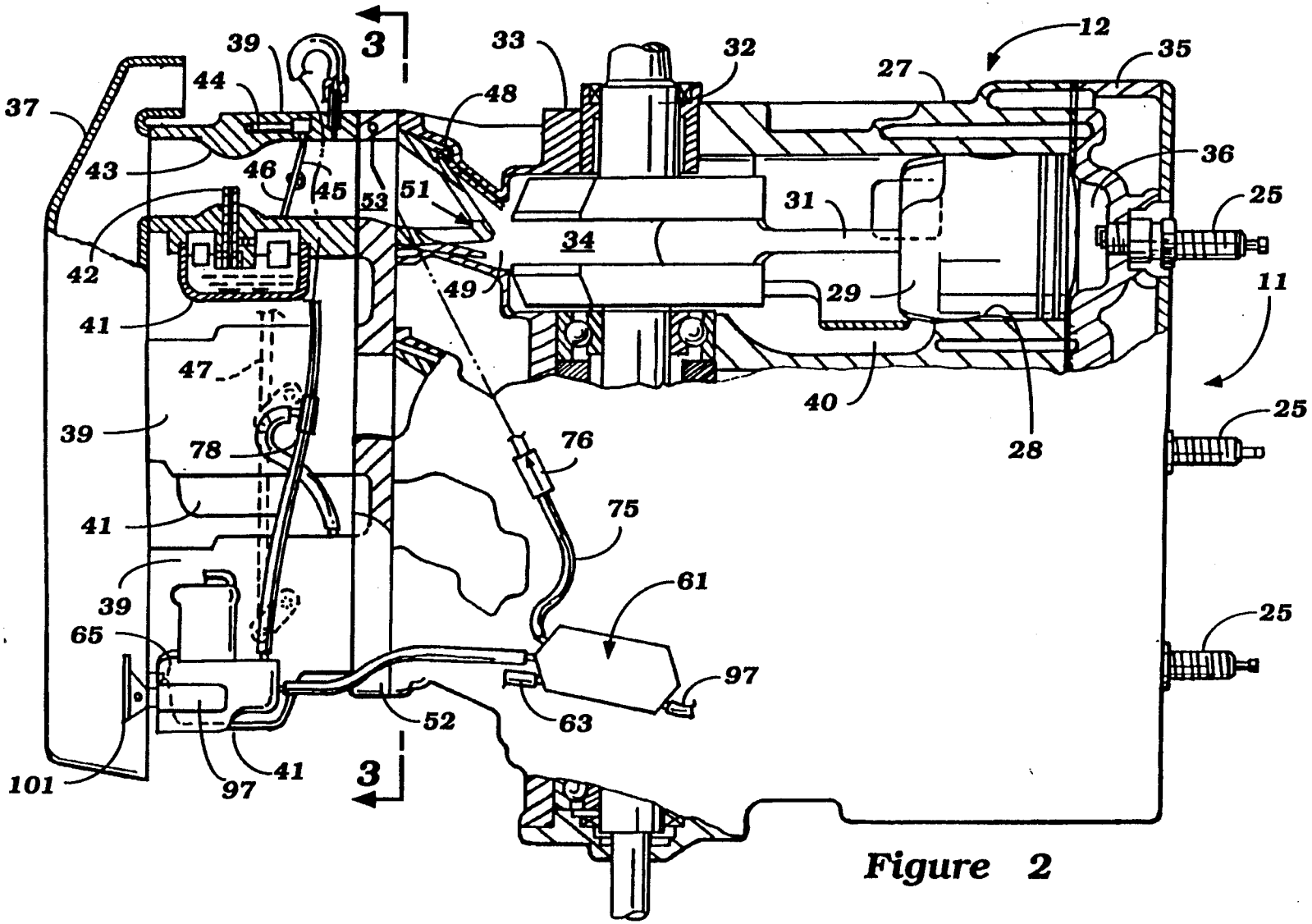
FIG. 2 is an enlarged side elevational view of the engine, with portions broken away and other portions shown in sections.
Figure 3:
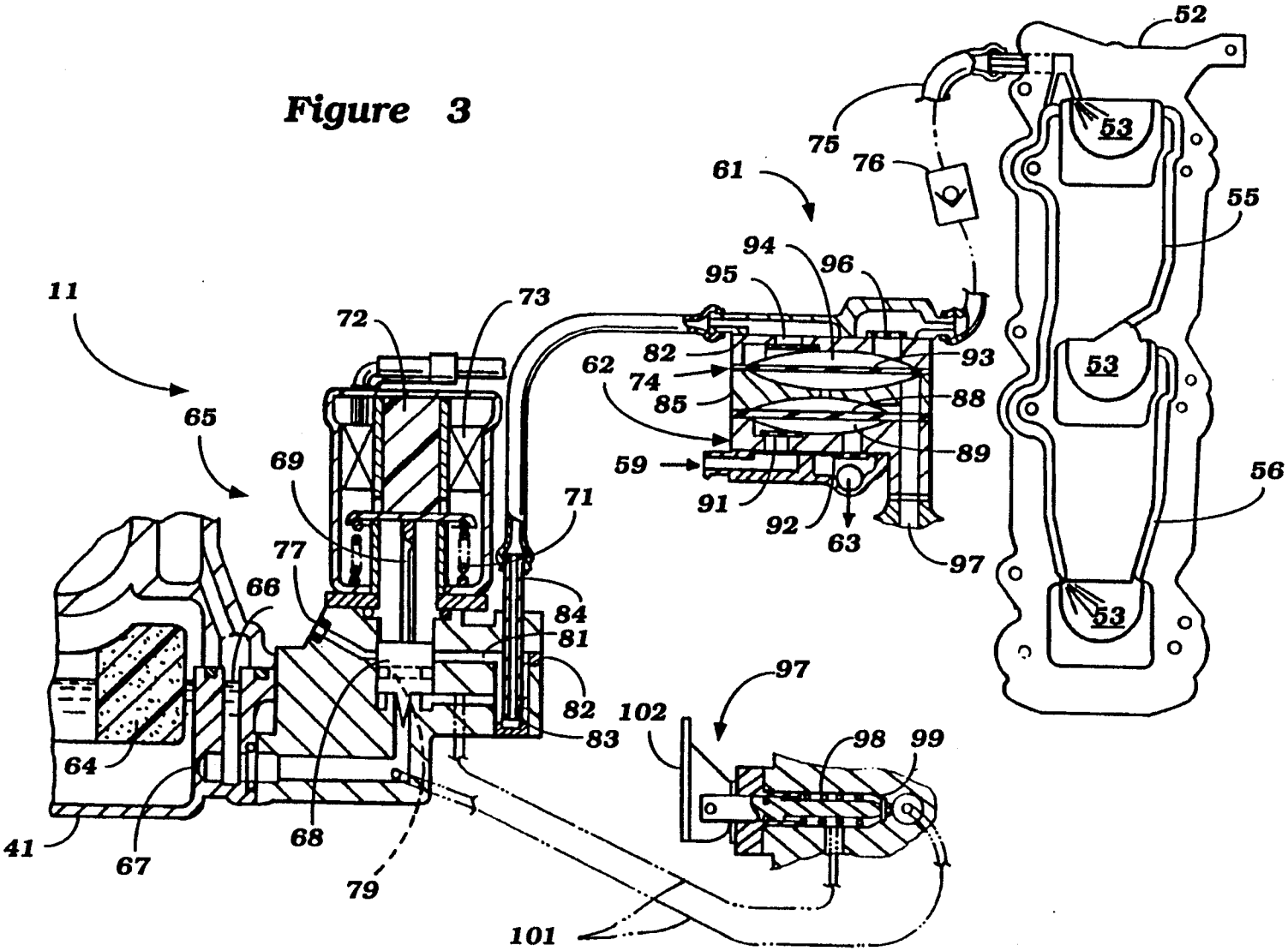
FIG. 3 is a partial cross sectional taken along the line 3—3 of FIG. 1 and partial schematic view showing the additional fuel supply system of another embodiment.

Referring now primarily to FIGS. 2 and 3, it will be seen that the engine 12 is comprised of a cylinder block 27 in which a plurality of cylinder bores 28 are formed.

In the illustrated embodiments, the engine 12 is of the three cylinder, inline type although the invention can be utilized in conjunction with engines having other than three cylinders. However, the invention has particular utility in conjunction with engines that have multiple chambers such as multiple cylinders in the case of a reciprocating engine.

Pistons 29 are supported for reciprocation with each of the cylinder bores 28 and are connected by means of connecting rods 31 to a crankshaft 32. The crankshaft is rotatably journaled between the cylinder block 27 and a crankcase 33 about a vertically extending axis as aforenoted As is conventional with two-cycle internal combustion engines, the crankcase 32 forms a plurality of crankcase chambers 34, each associated with a respective of the cylinder bores 28 with the crankcase chambers 34 being sealed from each other in a suitable manner.

A cylinder head 35 is affixed to the cylinder block 27 in a known manner and defines individual recesses 36 which cooperate with the pistons 29 and cylinder bores 28 to provide chambers which vary in volume as the pistons 29 reciprocate. These chambers 36 may referred to as the combustion chambers.

A main charge forming system is for delivering a fuel/air charge to each of the individual crankcase chambers 34. The charge is compressed in the crankcase chambers 34 and delivered to the combustion chambers 36 through scavenge passages 40. In this embodiment, this charge forming system includes an air inlet device 37 that draws atmospheric air from the area within the protective cowling of the outboard motor. Air is admitted to this internal chamber through a suitable external air inlet such as the inlet 38 shown in FIG. 1.

The air inlet device 37 supplies air to a plurality of carburetors, each of which is indicated by the reference numeral 39. Each carburetor 39 is comprised of a fuel bowl 41 to which fuel is supplied by means of an appropriate fuel supply system to be described and in which fuel is maintained at a level head by means of a float operated valve. A main fuel discharge nozzle 42 extends from the fuel bowl 41 into a venturi section 43 of the carburetors 39.

Each carburetor 39 further includes an idle fuel discharge system that is supplied from the fuel bowl 41 in a known manner that includes a passageway 44 and discharge port 45. The discharge ports 45 are located in proximity to throttle valves 46 that are positioned downstream of the venturi sections 43 and which control the flow of fuel/air mixture supplied to the engine in a known manner. The throttle valves 46 are all linked together by means of a linkage system 47 so that their movement will be synchronized.

In conventional engine practice, the carburetors 39 communicate directly with an intake manifold, indicated generally by the reference number 48 and which has a plurality of individual intake passages 49, each of which serves respective one of the crankcase chambers 34. Reed type check valves 51 are positioned in each of the manifold passages 49 so as to preclude reverse flow through the manifold passages 49.

In accordance with the invention, however, a spacer plate 52 is interposed between the carburetors 39 and the manifold 48. The spacer plate 52 has individual passageways 53 that provide communication between the carburetor flow passages and the manifold passages 49. Furthermore, and as test seen in FIG. 3, the spacer plate 52 is formed with a plurality of balance passages 54, 55 and 56 that communicate the passages 53 with each other. The balance passages 54, 55 and 56 tend to dampen the variations in vacuum pressure ration within the intake passages 53 and those passages 49 of the manifold as described in the copending application entitled Fuel Supply System for Plural Cylinder Engine, Ser. No. 345,614, filed Apr. 14, 1989 and now U.S. Ser. No. 4,917,053 and assigned to the assignee of this application.

In accordance with the invention additional or supplemental fuel for certain running or ambient conditions is supplied to the balance passages or certain of them in order to respond to a predetermined condition. In this particular embodiment, the supplemental fuel is supplied so as to assist cold starting and/or cold running.

Figure 4:
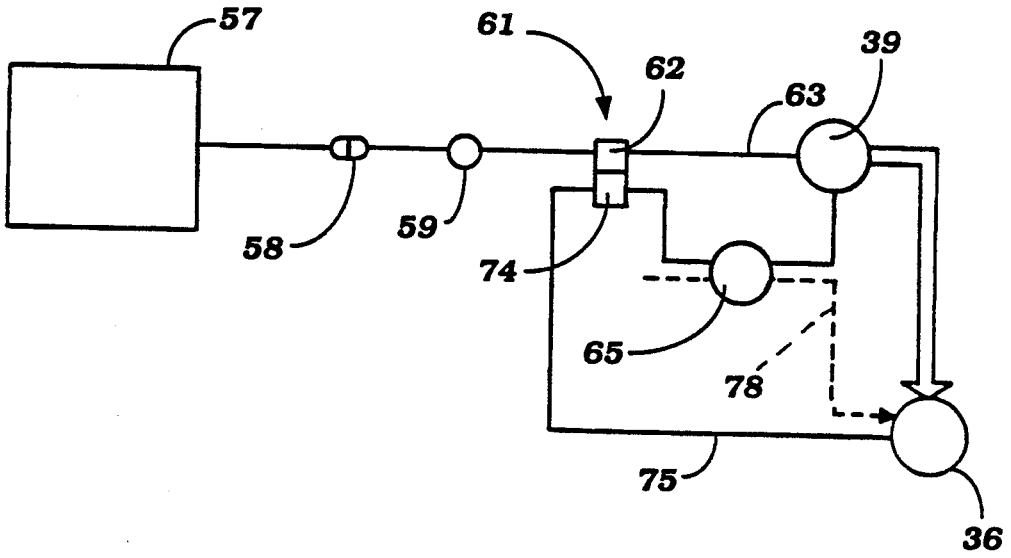
FIG. 4 is a schematic view showing the construction of the embodiments of FIGS. 1 and 2 and of FIG. 3.

Both the main and supplemental or additional fuel supply systems obtain fuel from a remotely positioned fuel tank 57 which is shown schematically in FIG. 4 through a quick disconnect coupling 58 that delivers fuel from this remote source to a fuel filter assembly 59 that is contained within the power head of the engine. This fuel filter assembly 59 delivers fuel to a compound fuel pump assembly 61, which will be described, and which includes a first pumping section 62 that delivers fuel to the fuel bowl 41 of the individual carburetors 39 through a fuel manifold assembly indicated schematically at 63.

As has been previously noted, the fuel is maintained at a constant level in the fuel bowl 41 in known manner and this includes a needle valve assembly (not shown) that is controlled by a float 64 positioned in the fuel bowl 41. The enrichment system includes an enrichment control mechanism 65 that receives fuel from the fuel bowl of one of the carburetors 39, in this instance the lower cost carburetor 39. The enrichment fuel control system 65 includes a fuel well 66 that is fed from the float bowl 41 of the lower cost carburetor 39 through a restricted metering jet 67. Fuel flows from the well 66 into a passageway that is controlled by means of a moveable valve member 68 that is operated by means of a control rod 69. A coil compression spring 71 normally urges the valve member 68 to its opened position. However, a wax pellet 72 is surrounded by an electrical heating coil 73 when the ignition is switched on and when heated will expand and urge the valve 68 to the closed position shown in FIG. 3. The system is such that when the engine has been shut off and is cold, the wax pellet 72 will contact and the valve 68 will be urged to the open position by the spring 75 so as to deliver fuel to a supplemental fuel pumping section 74 of the compound fuel pump 61. This fuel is then delivered through a conduit 75 in which a one way check valve 66 is provided that delivers fuel to supplemental fuel discharge nozzles formed in the spacer plate 52. This supplemental fuel may be delivered to one or more of the balance passageways 54, 55 and 56 for distribution to desired cylinders of the engine so as to provide cold starting enrichment as described in aforenoted U.S. application Ser. No. 345,614.

The operation is such that when the valve element 68 is initially opened the fuel from the well 66 will be rapidly depleted so as to provide an additional priming fuel for initial cranking. However, once the fuel in the well 66 has been depleted, the metering jet 67 will control the amount of supplemental cold running fuel delivered to the engine during the time when the valve 68 is open.

In addition to providing a supplemental fuel flow to the engine 12 for its cold starting and cold running operation, it is also desirous to provide additional air flow under this condition so as to maintain the proper air fuel ratio. To this end, there is provided an air metering jet 77 in the control device 65 which is also controlled by the valve member 68. The air metering jet 77 may provide air to the engine directly through an air manifold 78 that communicates with the individual carburetors downstream of their throttle valves 46 when the valve element 68 is opened as shown in the FIGS. 1, 2 and 4. Alternatively, this supplemental air may be mixed with the fuel so as to provide an air fuel emulsion and such an arrangement is shown in FIG. 3. It should be noted that the valve member 69 is provided with a relief 79 that communicates with an air flow port and communicates the air flow with a passageway 81 formed above an emulsion tube 82 that extends into a well 83 of the enrichment control device 65. This communication occurs when the valve member 68 is opened and delivers this emulsion through a tube 84 to the conduit that supplies fuel to the supplemental pumping section 74 of the compound fuel pump 61.

Referring now in detail to FIG. 3, the construction and operation of the compound fuel pump 61 will be described. The fuel pump 61 is comprised of a housing having a center piece 85 and a pair of end pieces 86 and 87. A first pumping diaphragm 88 is positioned between the pieces 85 and 86 and defines a pumping chamber 89 to which fuel is admitted from the fuel filter 59 through an inlet check valve 91. This occurs when the volume of the pumping chamber 89 is increasing. When the volume of this chamber 89 is decreasing, the fuel is delivered through a discharge check valve 92 to the conduit 63 for delivery to the carburetors 39 in the manner previously described.

A second pumping diaphragm 93 is positioned between the housing pieces 85 and 87 and defines a pumping chamber 94 that receives fluid from the tube 84 through a delivery check valve 95. The fuel is discharged to the conduit 75 through a discharge check valve 96.

Besides the pumping chambers 89 and 94, the two pump components 62 and 64 are provided with vacuum chambers that receive a vacuum signal from one of the crank case chambers 34 through a conduit 100. As a result, these pumping element 88 and 93 will be operated in unison and thus the same drive mechanism is contained the pump housing resulting in a very simple and compact assembly and one that nevertheless provides independent pumps for both the main and auxiliary fuel discharge.

There is provided a manually operated enrichment valve, indicated generally by the reference numeral 97 that is operative in order to bypass the control valve 65 in the event of some failure of it. This valve 97 includes a slidably supported valve member 98 having a control portion 99 that will open a bypass passageway, shown schematically at 101 when a manual release actuator 102 is operated. This will permit manual enrichment either if desired or in the event of some failure of the control device 65.

Figure 6:
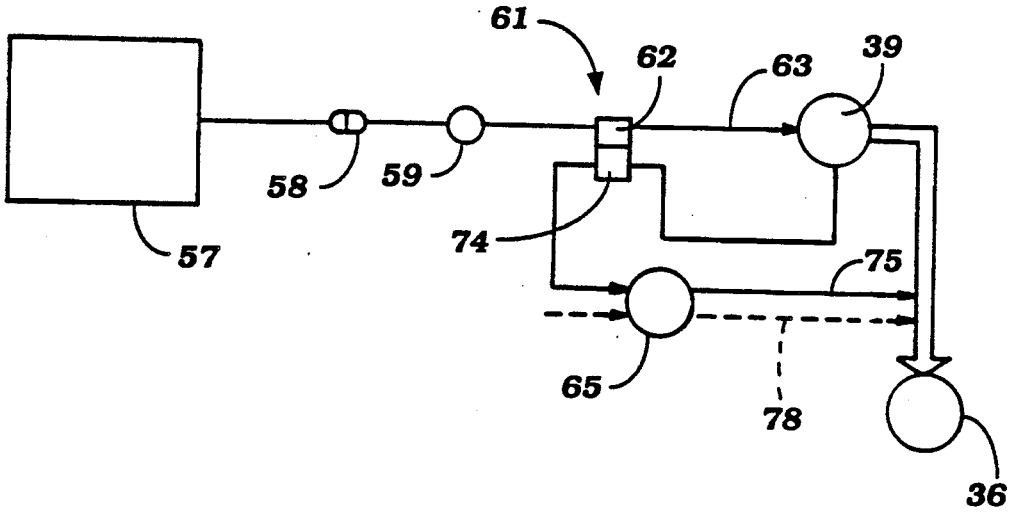
FIG. 6 is schematic view showing the construction of the embodiment of FIG. 5.
Figure 5:
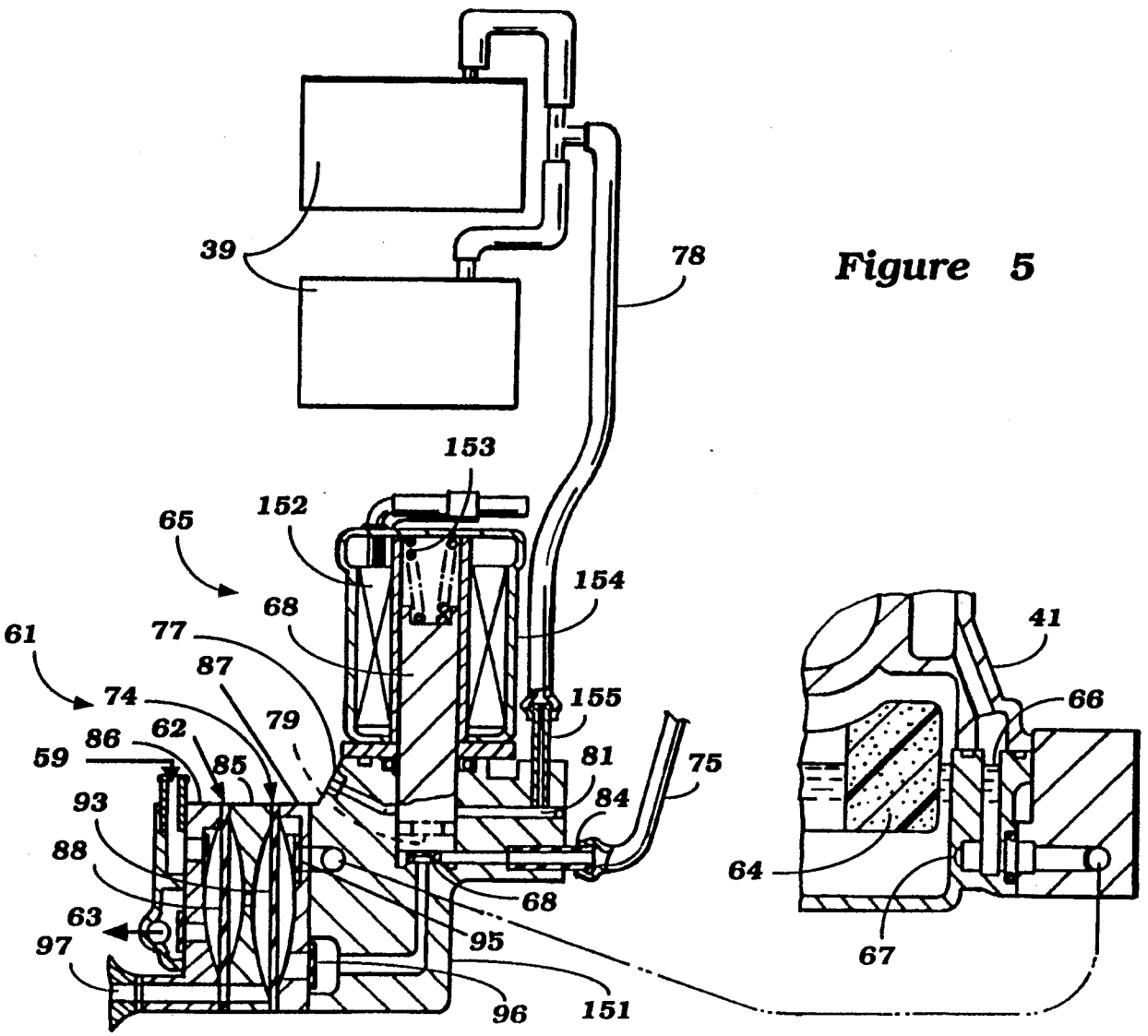
FIG. 5 is a partial cross sectional view, partial schematic view in part similar to FIG. 3 and shows yet another embodiment of the invention.

In the embodiments thus far described, a wax pellet was employed for operating the supplement auxiliary control fuel control 65 and the supplemental pumping device 74 was located downstream of this control. In addition, the compound fuel pump 61 was formed as a separate component from the fuel control 65. FIGS. 5 and 6 show an embodiment wherein the compound fuel pump 61 is formed as part of the same housing of the supplemental fuel control 65 and also wherein the pumping section 74 for the supplemental fuel is downstream of the control valve rather than upstream of it. In addition, this embodiment employs a solenoid operated valve for the fuel control rather than a heated wax pellet and thus can be utilized to provide supplemental fuel under conditions other than temperature or can also operate under temperature control for the use of an appropriate sensor. Because of the similarity of this embodiment to the previously described embodiments, components which are substantially the same as those previously described have been identified by the same reference numerals and will be described only insofar as is necessary to understand the construction and operation of this embodiment.

In this embodiment it will be noted that the pump housing pieces 85, 86, and 87 are directly affixed to an outer body 151 of the control device 65. The control device 65 includes a valve member 68 which also forms an armature of a solenoid winding 152. A coil compression spring 153 normally urges the valve 68 to its closed position. The value member 68 is slidably supported in a core 154 of the solenoid 152 and when the solenoid 152 is actuated the valve member 68 will open and function as in the copending application entitled "Fuel Boosting System For Internal Combustion Engine", Ser. No. 374,292, filed on June 30, 1989 and assigned to the assignee of this application. In this particular embodiment, the air control valve portion 79 cooperates with an air supply passage 154 having a fitting 155 that communicates with the air manifold or supply line 78 as in the embodiment of FIGS. 1 and 2.

It should be readily apparent from the foregoing descriptions that a number of embodiments of the invention have been illustrated and described and each of which is highly effective in providing a very well controlled supply of supplemental fuel for abnormal running conditions such as cold starting or the like. Although several embodiments of the invention have been illustrated and described various changes and modifications may be made without departing from the spirit and scope of the invention, as defined by the appended claims.

We claim:

1. In a fuel supply system for an internal combustion engine comprising a main fuel discharge for supplying running fuel to said engine for normal runnings, first pressure operated fuel pump means for supplying fuel to said main fuel discharge, an additional fuel supply for said engine for supplying additional fuel to said engine for a specific running condition, and a second pressure operated fuel pump for supplying fuel to said additional fuel supply, said first and said second pressure operated fuel pumps being formed in the same housing, and actuated by the same pressure source.

2. In a fuel supply system for an internal combustion engine as set forth in claim 1 wherein the main fuel discharge comprises a charge forming device.

3. In a fuel supply system for an internal combustion engine comprising a main fuel discharge for supplying running fuel to said engine for normal runnings, first fuel pump means for supplying fuel to said main fuel discharge, an additional fuel supply for said engine for supplying additional fuel to said engine for a specific running condition, and a second fuel pump for supplying fuel to said additional fuel supply, said first and second fuel pumps being formed in the same housing, said main fuel discharge comprising a charge forming device and the additional fuel is supplied to the engine downstream of the point where said charge forming device supplies fuel to the engine.

4. In a fuel supply system for an internal combustion engine as set forth in claim 3 further including means for supplying supplemental air to the engine when the additional fuel supply is in operation.

5. In a fuel supply system for an internal combustion engine as set forth in claim 4 further including means for mixing the supplemental air with the additional fuel supplied to the engine.

6. In a fuel supply system for an internal combustion engine as set forth in claim 1 further including a control valve for selectively controlling the delivery of additional fuel to the engine.

7. In a fuel supply system for an internal combustion engine comprising a main fuel discharge for supplying running fuel to said engine for normal runnings, first fuel pump means for supplying fuel to said main fuel discharge, an additional fuel supply for said engine for supplying additional fuel to said engine for a specific running condition, and a second fuel pump for supplying fuel to said additional fuel supply, said first and second fuel pumps being formed in the same housing, a control valve for selectively controlling the delivery of additional fuel to said engine, said second fuel pump being positioned downstream of the control valve.

8. In a fuel supply system for an internal combustion engine comprising a main fuel discharge for supplying running fuel to said engine for normal runnings, first fuel pump means for supplying fuel to said main fuel discharge, an additional fuel supply for said engine for supplying additional fuel to said engine for a specific running condition, and a second fuel pump for supplying fuel to said additional fuel supply, said first and second fuel pumps being formed in the same housing, a control valve for selectively controlling the delivery of additional fuel to said engine, said second fuel pump being positioned upstream of the control valve.

9. In a fuel supply system for an internal combustion engine as set forth in claim 6 wherein the fuel pump housing and the control valve are affixed to each other.

10. In a fuel supply system for an internal combustion engine as set forth in claim 1 wherein the common pressure source for the first and second fuel pumps comprises the pressure in the crankcase of the associated engine.

11. In a fuel supply system for an internal combustion engine as set forth in claim 1 wherein the first and second pumps are diaphragm type pumps.

12. In a fuel supply system for an internal combustion engine as set forth in claim 11 wherein the diaphragm type pumps comprise respective first and second diaphragms clamped together in a common housing.

13. In a fuel supply system for an internal combustion engine comprising a main fuel discharge for supplying main running fuel to said engine for normal running conditions, first fuel pump means for supplying fuel to said main fuel discharge, an additional fuel supply for said engine for supplying additional fuel to said engine for specific running conditions, and a second fuel pump for supplying fuel to said additional fuel supply, said first and said second fuel pumps being operated by the same operator, said main fuel discharge comprising a charge forming device and the additional fuel is supplied to the engine downstream of the point where said charge forming device supplies fuel to the engine.

14. In a fuel supply system for an internal combustion engine as set forth in claim 13 further including means for supplying supplemental air to the engine when the additional fuel supply is in operation.

15. In a fuel supply system for an internal combustion engine as set forth in claim 14 further including means for mixing the supplemental air with the additional fuel supplied to the engine.

16. In a fuel supply system for an internal combustion engine as set forth in claim 13 further including a control valve for selectively controlling the delivery of additional fuel to the engine.

17. In a fuel supply system for an internal combustion engine comprising a main fuel discharge for supplying main running fuel to said engine for normal running conditions, first fuel pump means for supplying fuel to said main fuel discharge, an additional fuel supply for said engine for supplying additional fuel to said engine for specific running conditions, and a second fuel pump for supplying fuel to said additional fuel supply, said first and said second fuel pumps being operated by the same operator, a control valve for selectively controlling the delivery of additional fuel to the engine and said second fuel pump is downstream of said control valve.

18. In a fuel supply system for an internal combustion engine comprising a main fuel discharge for supplying main running fuel to said engine for normal running conditions, first fuel pump means for supplying fuel to said main fuel discharge, an additional fuel supply for said engine for supplying additional fuel to said engine for specific running conditions, and a second fuel pump for supplying fuel to said additional fuel supply, said first and said second fuel pumps being operated by the same operator, a control valve for selectively controlling the delivery of additional fuel to the engine and said second fuel pump is upstream of said control valve.

19. In a fuel supply system for an internal combustion engine as set forth in claim 17 wherein the fuel pump housing and the control valve are affixed to each other.

20. In a fuel supply system for an internal combustion engine as set forth in claim 2 wherein the additional fuel is supplied to the engine downstream of the charge forming device.

21. In a fuel supply system for an internal combustion engine as set forth in claim 20 further including means for supplying supplemental air to the engine when the additional fuel supply is in operation.

22. In a fuel supply system for an internal combustion engine as set forth in claim 21 further including means for mixing the supplemental air with the additional fuel supplied to the engine.

23. In a fuel supply system for an internal combustion engine as set forth in claim 6 wherein the second fuel pump is downstream of the control valve.

24. In a fuel supply system for an internal combustion engine as set forth in claim 6 wherein the second fuel pump is upstream of the control valve.

25. In a fuel supply system for an internal combustion engine as set forth in claim 6 wherein the fuel pump housing and the control valve are affixed to each other.

* * * * *